US005555876A

United States Patent [19]

Francisco, Jr. et al.

[11] Patent Number: 5,555,876

[45] Date of Patent: Sep. 17, 1996

[54] CHIMNEY SAFETY AND CONTROL SYSTEM

[76] Inventors: Richard V. Francisco, Jr.; Jack E. Farrell, III, both of 1100 Pennsylvania Ave., Wilmington, Del. 19806

[21] Appl. No.: 324,242

[22] Filed: Oct. 17, 1994

[51] Int. Cl.[6] ..... F23L 11/00

[52] U.S. Cl. ..... 126/504; 236/1 G; 454/16

[58] Field of Search ..... 110/162, 185; 126/285 B, 286, 502, 504; 454/1, 16, 27, 28, 29, 30, 31; 236/1 G

[56] References Cited

U.S. PATENT DOCUMENTS

| | | | |
|---|---|---|---|
| 3,580,238 | 5/1971 | Diehl | 251/129 X |
| 4,204,832 | 5/1980 | Miller | 110/162 X |
| 4,250,868 | 2/1981 | Frye | 126/502 |
| 4,273,097 | 6/1981 | Szwartz | 126/285 B |
| 4,487,137 | 12/1984 | Horvat et al. | 110/162 |
| 4,649,808 | 3/1987 | Ward et al. | 126/504 X |

FOREIGN PATENT DOCUMENTS

| | | | |
|---|---|---|---|
| 133606 | 2/1985 | European Pat. Off. | 126/504 |
| 2481420 | 10/1981 | France | 126/502 |
| 3133230 | 3/1983 | Germany | 126/285 B |

*Primary Examiner*—Harold Joyce

*Attorney, Agent, or Firm*—Evelyn M. Sommer; Skadden, Arps, Slate, Meagher & Flom

[57] ABSTRACT

A chimney safety and control system includes a control panel which indicates the position of the chimney damper and the operational status of a chimney fan unit, and allows the operator to electro-mechanically open and close the damper and set the fan. When the safety control system senses that a predetermined condition (e.g., high temperature) exists in the chimney firebox while the damper is closed, it automatically opens the damper and activates the fan. The system may also be used in conjunction with one or more smoke detectors, in which case the system automatically opens the damper and activates the fan when a smoke detector is activated.

6 Claims, 5 Drawing Sheets

CHIMNEY SAFETY AND CONTROL SYSTEM

BACKGROUND OF THE INVENTION

This invention relates generally to a chimney safety and control system for expelling deleterious byproducts of fires in a fireplace associated with a chimney, automatically reducing the risk of house (or other building) fires, and improving the drafting process in starting fires in the fireplace.

The escape of smoke and carcinogenic solids from a fireplace associated with a chimney into the house (or other building) has been a frequent problem associated with fireplaces and chimneys. Previously, chimneys have been provided with a damper which is opened when a fire is present in the fireplace and closed when the fireplace and chimney are not being used. These systems, however, leave the important task of opening and closing the chimney damper to the house occupant. If the occupant should start a fire when the damper is closed, the house will rapidly fill with smoke, causing significant annoyance and health hazards, and greatly increasing the possibility of a house fire. The occupant may also close the damper for the night after using the fireplace, thinking that the fire in the fireplace has burned itself out. However, unbeknownst to the occupant, embers in the fire may continue to smolder for some time, causing considerable smoke to enter the house. Occupants have no way of knowing of these problems until enough smoke has filled the house to either set off a smoke alarm or become noticeable to the occupants. Someone must then rush over and open the damper. If no one is present, there is no way to stop the continuous flow of smoke into the house.

Another problem with conventional chimneys and fireplaces is that the occupant can only determine the position of the damper by visual inspection. Therefore, if the damper is accidentally closed or closes by itself before or after a fire was started in the fireplace, the occupant has no way of knowing of this problem other than by visually inspecting the damper itself. Conversely, if the damper has been left open when the fireplace is not in use, undesirable cold air may enter the house.

Yet another problem with previous chimneys is that a cold head of air often settles in the flue-liner cavity and throat area, making fires difficult to start. These chimneys have no means for assisting the draft process when it is unable to take place under such conditions.

It would be therefore be desirable to provide a system which protects house occupants from life-threatening smoke and carcinogenic solids generated by fires in a fireplace associated with a chimney.

It would also be desirable to provide a system which automatically reduces the risk of accidental house fires caused by fires in a fireplace associated with a chimney.

It would further be desirable to provide a system which sounds an alarm or provides a visual indication when a dangerous condition occurs in the fireplace or chimney increasing the possibility of a house fire.

It would be still further desirable to provide a system which improves the draft process in starting a fire in a fireplace associated with a chimney.

It would be even further desirable to provide a system which prevents smoke from fires in a fireplace associated with a chimney from infiltrating adjacent room areas of a house, thereby eliminating smoke odor and soot.

SUMMARY OF THE INVENTION

It is therefore an object of the present invention to provide a system which protects house occupants from life-threatening smoke and carcinogenic solids generated by fires in a fireplace associated with a chimney.

It is a further object of this invention to provide a system which automatically reduces the risk of accidental house fires caused by fires in a fireplace associated with a chimney.

It would further be desirable to provide a system which sounds an alarm or provides a visual indication when a dangerous condition occurs in the chimney or fireplace increasing the possibility of a house fire.

It is a further object of this invention to provide a system which improves the draft process in starting a fire in a fireplace associated with a chimney.

It is a further object of this invention to provide a system which prohibits smoke from fires in a fireplace associated with a chimney from infiltrating adjacent room areas of a house, thereby eliminating soot and smoke odor.

The present system comprises a chimney safety and control system that allows an operator to more easily control chimney functions and prevents smoke from a fire in a fireplace associated with a chimney from entering the house. The system is adapted for use with a chimney including a firebox, a throat, a flue, a fan unit, and a damper. A damper solenoid allows the damper to be automatically opened and closed, and the current position of the damper to be sensed by a damper sensing switch. A firebox sensor located within the firebox senses the occurrence of a predetermined condition in the firebox, such as a temperature above a predetermined threshold or a predetermined concentration of natural gas.

A controller is electrically connected to the damper solenoid, the damper sensing switch, the firebox sensor, and a fan motor located within the fan unit. The controller may also be connected to one or more smoke alarms in proximity to the chimney. When the controller determines that the predetermined condition has occurred while the damper is closed, the controller automatically opens the damper, turns on the fan motor, and activates an alarm. The controller may also be adapted to activate one or more smoke alarms upon the occurrence of these conditions. In addition the controller can be adapted in the case where a dangerous situation does not exist to prevent transmission of the alarm situation to the responding fire department.

The controller may further be designed to sense when one or more smoke detectors have been activated, and upon this condition automatically open the damper and turn on the fan motor.

The system may also be provided with a control panel for indicating chimney conditions to the operator, allowing the operator to more easily control chimney functions. The control panel may include fan indicators for indicating the current state of the fan unit, and damper position indicators for indicating the current position of the damper. The control panel may also be provided with a fan control switch for allowing the user to manually turn the fan on and off and control the fan speed.

BRIEF DESCRIPTION OF THE DRAWINGS

The present invention will be understood and appreciated more fully from the following detailed description, taken in conjunction with the drawings, in which.

Figure 5:
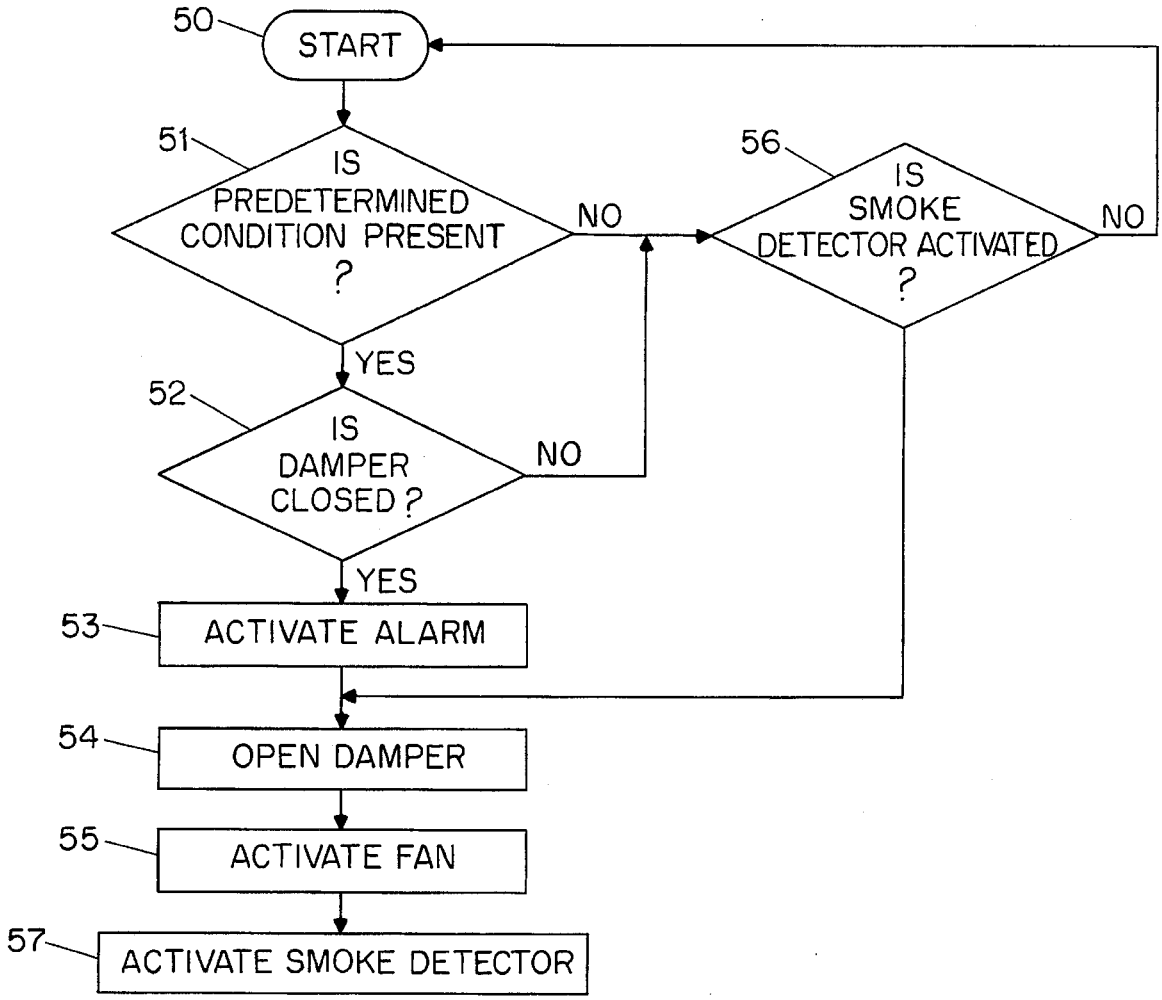
Figure 6:
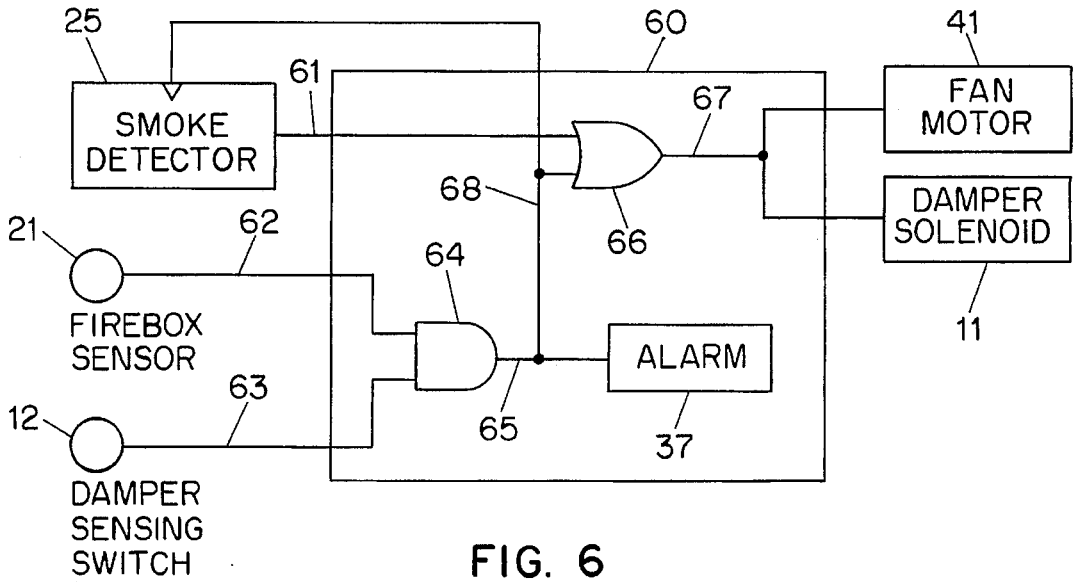
Figure 7:
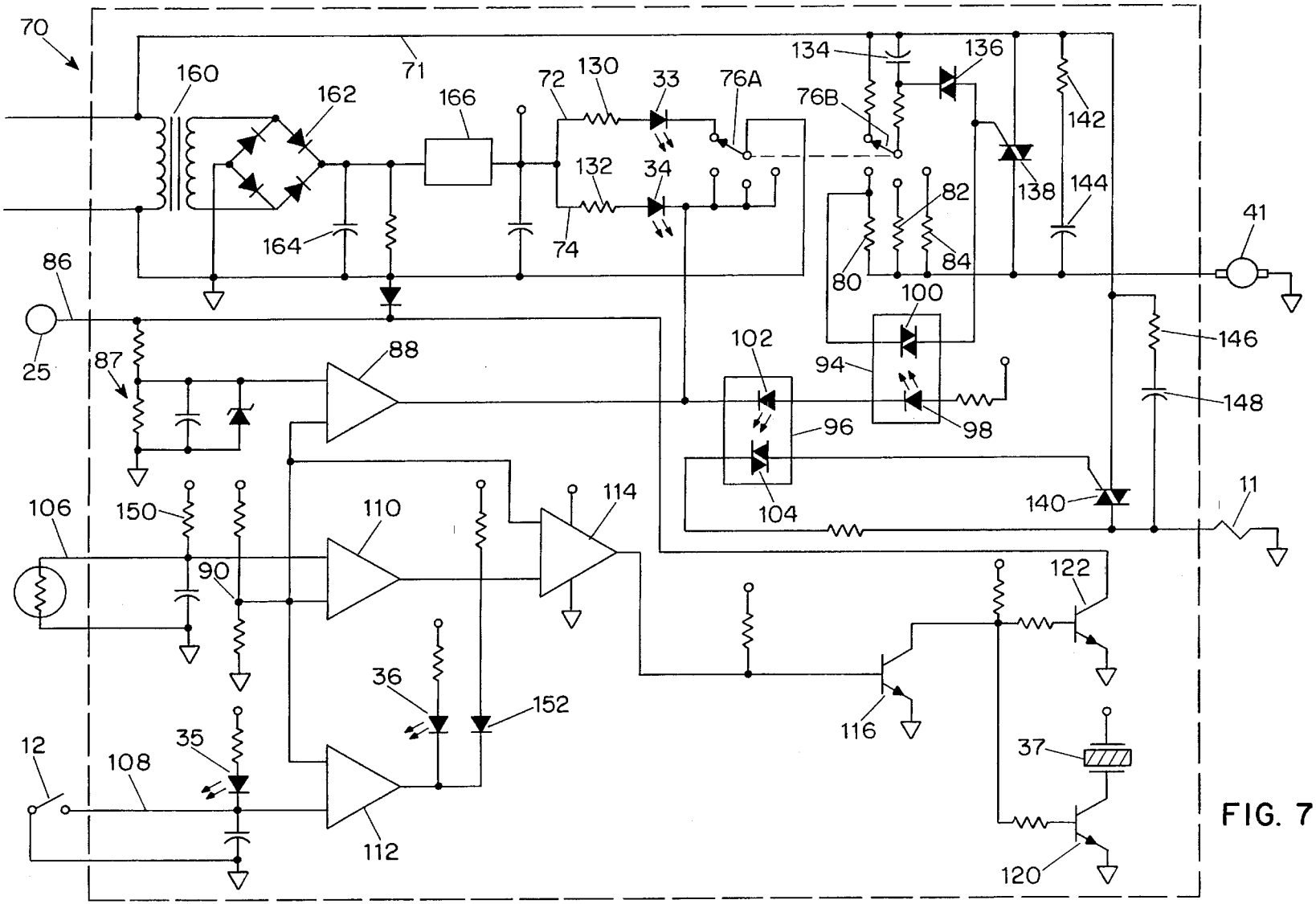

FIG, 4 is side view of a fan unit for a preferred embodiment of the present invention;

FIG. 5 is a flow chart showing a chimney safety control method in accordance with a preferred embodiment of the present invention;

FIG. 6 is a simplified block diagram of a control circuit for a preferred embodiment of the present invention; and FIG. 7 is a schematic drawing of a control circuit for a preferred embodiment of the present invention.

DETAILED DESCRIPTION OF THE INVENTION

By way of example, the present invention is illustrated in terms of a system for use in controlling the existing conditions in a chimney associated with a fireplace and for maintaining the safety of the chimney and fireplace. The example application described herein is only one example application of the present invention and is provided for the purpose of better explaining the present invention. The present invention may be applied to any number of other chimney safety and control systems and fire safety systems generally. Thus, the present invention should not be limited to the specific example described herein.

Figure 1:
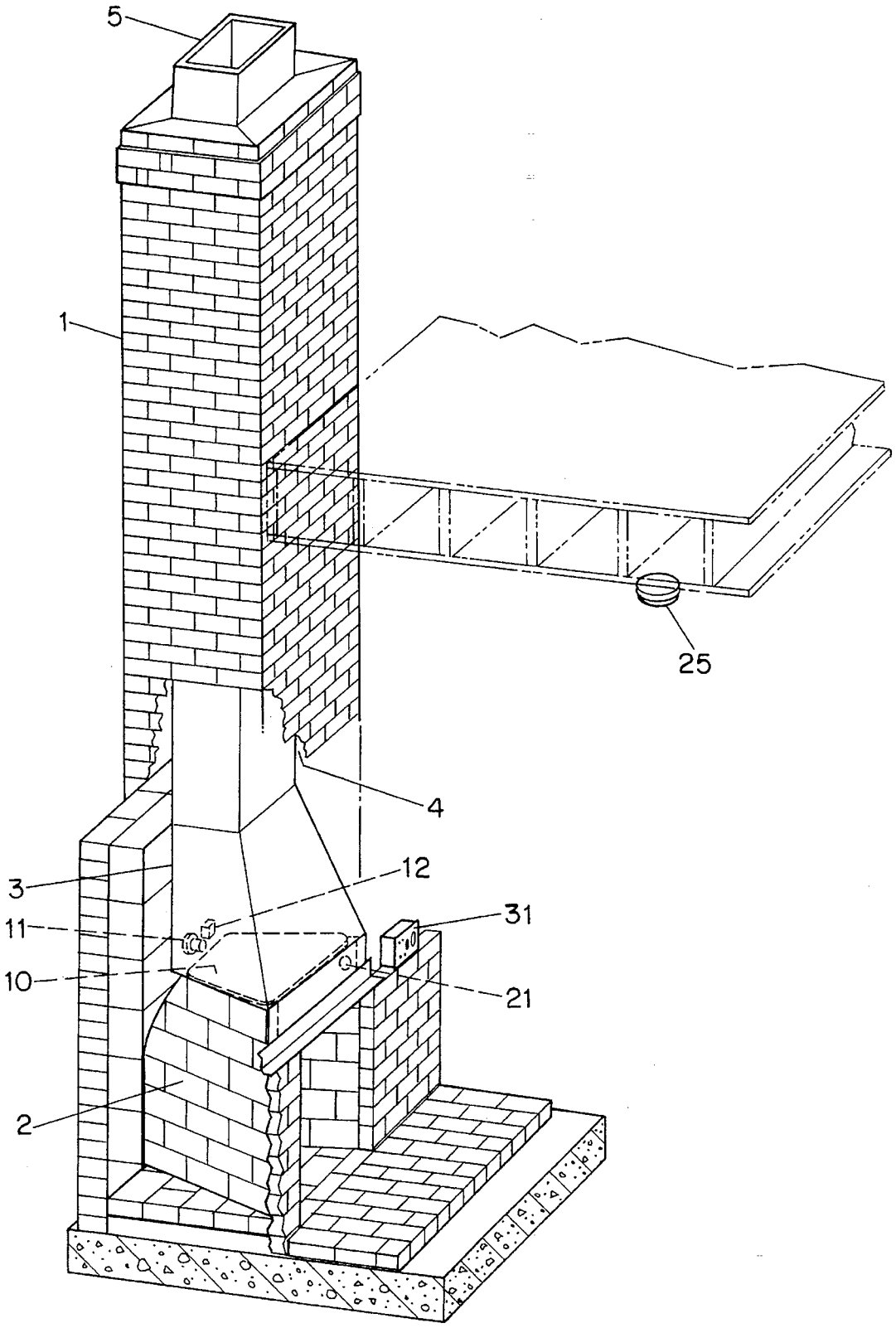
FIG. 1 is a perspective view of a chimney incorporating the safety and control system in a preferred embodiment of the present invention.

Illustrated in FIG. 1 is a chimney 1 which can incorporate the safety and control system of the present invention. Chimney 1 is depicted as having several standard features, including firebox 2, throat 3, flue 4, and flue-liner 5. Firebox 2 is an open portion at the base of chimney 1 which forms the portion of a fireplace in which the fire burns. Flue 4 allows for the passage of smoke generated by a fire in firebox 2 out of the house through an open portion at the top of flue 4. Throat 3 connects firebox 2 to flue 4. Chimney 1 also includes damper 10, which is located generally between firebox 2 and throat 3 and may be moved into different positions. For example, damper 10 may be closed, in which case firebox 2 is isolated from throat 3. When damper 10 is opened, a clear path exists between firebox 2 and throat 3.

Attached to damper 10 is damper solenoid 11 and damper sensing switch 12. Damper solenoid 11 is used to electromechanically move damper 10 from one position to another. Damper sensing switch 12 is used to determine, at any given time, the current position of damper 10. In the preferred embodiment, damper sensing switch 12 is a "plunger" type switch, in which movement of damper 10 into a predetermined position depresses a plunger, closing a circuit. Alternatively, damper sensing switch 12 may be a radiation sensor, wherein movement of damper 10 in front of the sensor interrupts a radiation beam, thereby closing a circuit. One skilled in the art will recognize that various other types of sensors may be used for damper sensing switch 12.

Chimney 1 also includes a firebox sensor 21 (shown in more detail in FIG. 2) for sensing a predetermined condition in the firebox, and a fan unit (shown in FIG. 4) mounted on top of flue liner 5. As shown in FIG. 1, the preferred embodiment also includes one or more smoke detectors 25, located above the front opening of firebox 2, in the area immediately surrounding chimney 1.

Figure 3:
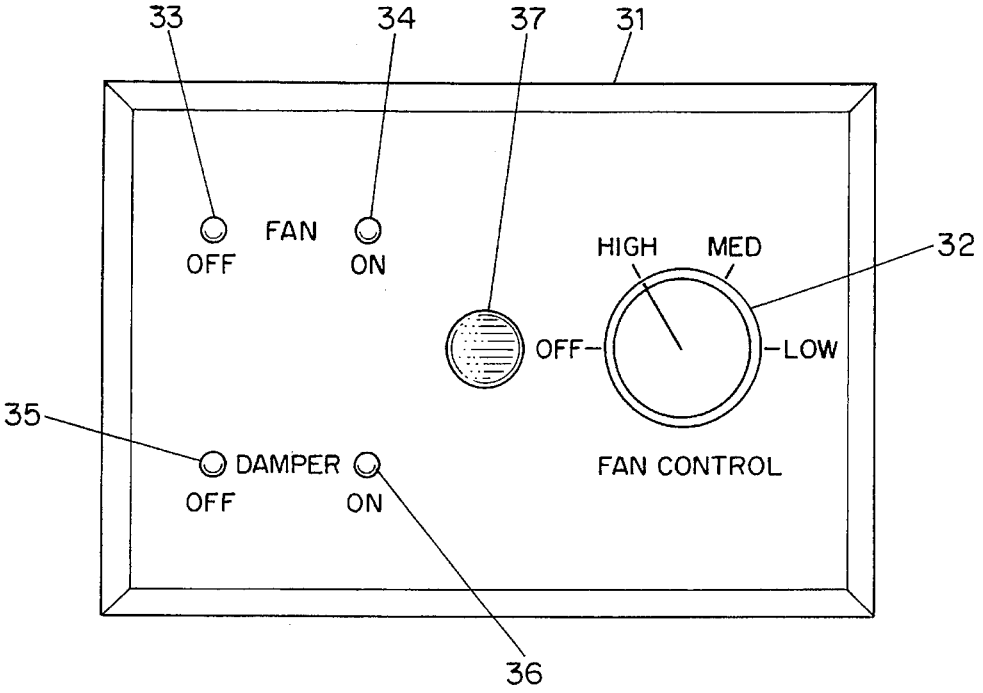
FIG. 3 is a front view of a control panel for a preferred embodiment of the present invention.
Figure 4:
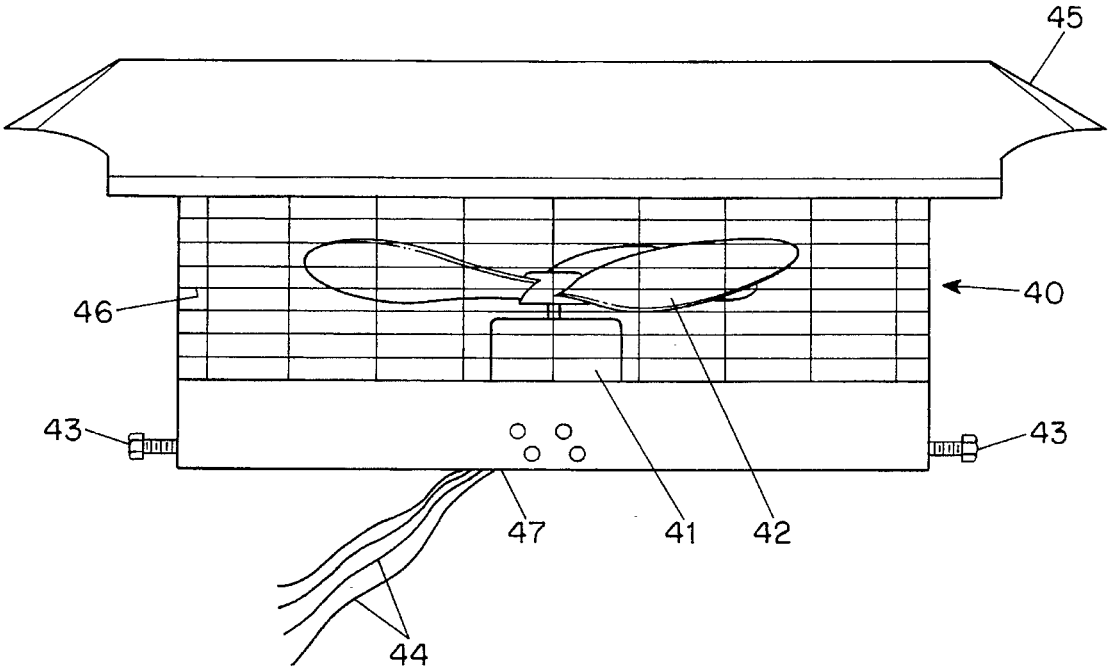

Chimney 1 further includes a control panel 31 (shown in more detail in FIG. 3) electrically connected to damper solenoid 11, damper sensing switch 12, firebox sensor 21, smoke detector 25, and a fan motor 41 located within the fan unit (shown in FIG. 4). The control panel is mounted to the firebox to allow easy access by an operator. The control panel indicates the present state of the damper and fan, and allows the user to control the damper and fan. The control panel is also connected to a control circuit (shown in FIGS. 6 and 7) for preventing smoke from entering the house.

Figure 2:
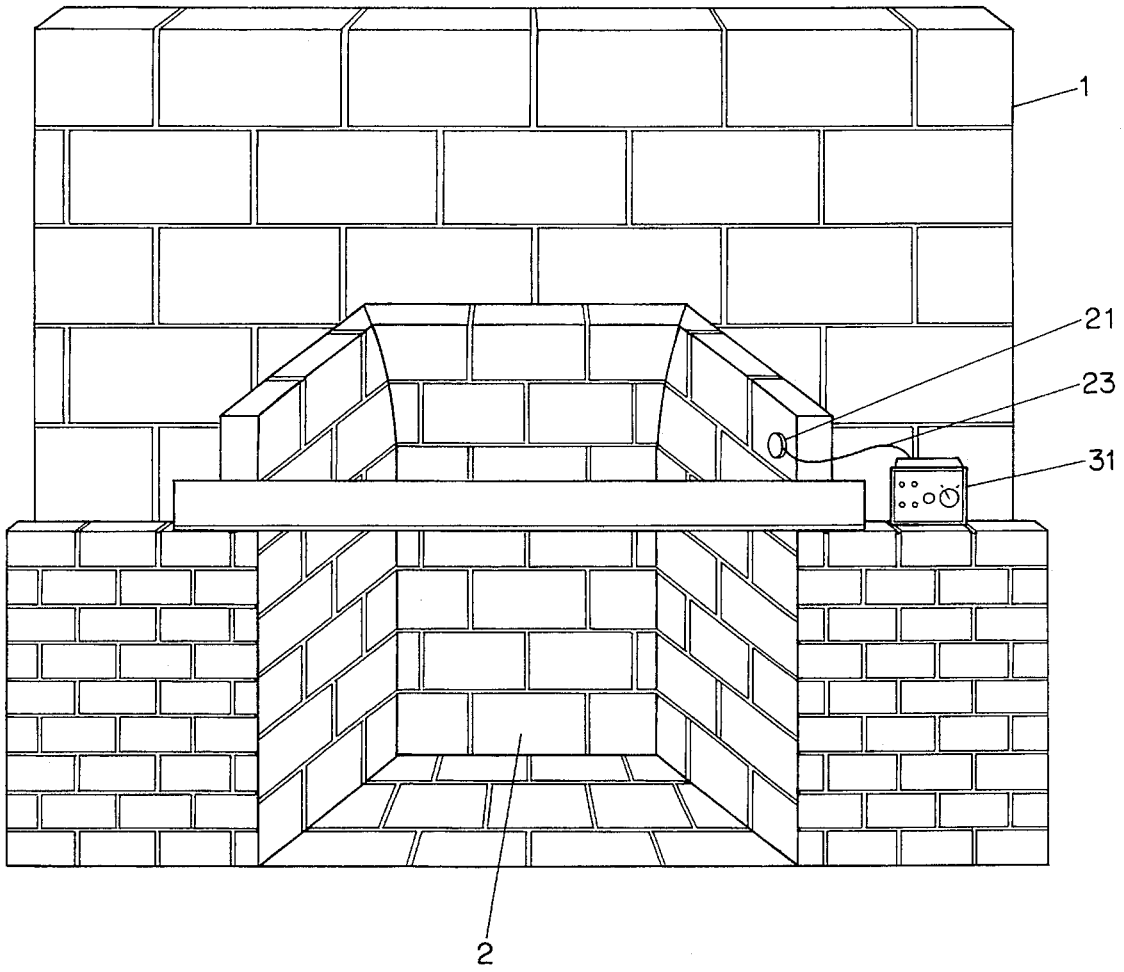
FIG. 2 is a partial front view of the chimney of FIG. 1.

FIG. 2 is a partial front view of the chimney of FIG. 1. As illustrated in FIG. 2, control panel 31 is preferably mounted immediately adjacent to the front opening of firebox 2. Firebox sensor 21 is located within firebox 2 and is electrically connected to control panel 31 by wire 23. Firebox sensor 21 senses when a predetermined condition has occurred. For example, in a first preferred embodiment of this invention, firebox sensor 21 is a thermistor, which determines when a fire is burning in firebox 2. In this embodiment, sensor 21 is preferably manufactured to determine when the temperature in firebox 2 exceeds a predetermined temperature, approximately 125 degrees Fahrenheit in this embodiment. In a second preferred embodiment, firebox sensor 21 is a gas concentration sensor, which determines when the concentration of natural gas or methane in the firebox rises above a predetermined level. One skilled in the art will also recognize that a variety of different types of sensors may be employed for firebox sensor 21, depending upon the condition or conditions to be sensed.

A front view of the control panel 31 of the first preferred embodiment of the invention is shown in FIG. 3. Control panel ! 31 includes a multi-position fan control switch 32, a set of fan indicators 33 and 34, a set of damper position indicators 35 and 36, and an alarm indicator 37.

Fan control switch 32 allows an operator to manually switch fan motor 41 (shown in FIG. 4) on and off, as well as manually adjust its speed. In the embodiment shown in FIG. 3, the operator can control fan motor 41 by moving fan control switch 32 to the desired position. In the embodiment shown in FIG. 3, fan control switch has four positions: an "off" position, as well as "high," "medium" and "low" positions for adjusting fan speed. One skilled in the art will recognize that fan motor 41 is not limited to three speeds, and various different speed combinations can be employed. In such a case, fan control switch 32 will have a position corresponding to each speed of fan motor 41, plus an off position. Fan control switch 32 may also be provided as a set of switches rather than a rotatable knob, or any other suitable switch system. By allowing the operator to manually control fan motor 41, a cold head of air that has settled in the flue liner cavity and throat area can be easily removed by operator control, assisting the draft process and making fires easier to start.

Control panel 31 also preferably includes a set of fan speed indicators 33 and 34, for indicating whether or not the fan unit is currently operating. Indicators 33 and 34 are preferably light-emitting diodes ("LED's"), but one skilled in the art will recognize that they may be any form of display means, including liquid-crystal display panels. In the preferred embodiment, red LED 33 remains lit while fan motor 41 is off, and green LED 34 remains lit while fan motor 41 is engaged in either "high," "medium," or "low" speeds.

Control panel 31 further preferably includes a set of damper position indicators 35 and 36. Indicators 35 and 36 preferably consist of one red LED and one green LED, but may also take the form of any other suitable display means. In the preferred embodiment, red LED 35 remains lit while damper 10 is closed and green LED 36 remains lit while damper 10 is open. Control panel 31 may also include a damper control switch (not shown) for allowing an operator to automatically open and close the damper by activating the switch.

Control panel 31 also preferably includes an alarm 37. In the embodiment shown in FIG. 3, alarm 37 is a red lamp on control panel 31, however, any form of audible or visual indicator, or combination thereof may be used. Alarm 31 indicates that the safety system has been activated.

The preferred embodiment of the present invention preferably includes a conventional fan unit 40, shown in FIG. 4, mounted on top of flue liner 5 (shown in FIG. 1). In the preferred embodiment, fan unit 40 includes a fan motor 41, fan blades 42, connecting wires 44, spark arrestor 45, and enclosure 46. Fan unit 40 includes an opening 47 in its bottom surface, i.e., the surface which rests on flue liner 5, which allows air to pass through fan unit 40. Mounting bolts 43 secure fan unit 45 to flue liner 5, and wires 44 electrically connect fan unit 40 to control panel 31 and a suitable power source (not shown).

Fan motor 41, which is preferably a multi-speed motor, and is preferably insulated against water and ash, drives fan blades 42 and is mounted within fan unit 40. When fan motor 41 is operating, fan blades 42 draw air from flue 4 and throat 3 in through opening 47 and out through opening 48. If damper 10 is open, air is drawn from firebox 2 as well.

Fan unit 40 is preferably surrounded by enclosure 46, which consists of wire meshing in the embodiment shown in FIG. 4, but may also be made of sheet metal or any other appropriate material suitable for preventing sparks or igniting substances from passing out of fan unit 40. A spark arrester 45 also encloses fan unit 40 from above. Spark arrester 45 may be constructed of any material suitable for preventing sparks or igniting substances from leaving fan unit 40. In the preferred embodiment, spark arrester 45 is made of sheet metal. Spark arrester 45 is also provided with an opening 48, similar to opening 47, to allow for passage of air through unit 40.

FIG. 5 is a flow chart showing a chimney safety control method in accordance with a preferred embodiment of the present invention. After the method is started (step 50), firebox sensor 21 determines whether a predetermined condition is present (step 51). As described above, this predetermined condition can occur when the temperature in firebox 2 exceeds a predetermined temperature, indicating that a fire is burning. Alternatively, this predetermined condition may occur when firebox sensor determines that the concentration of natural gas in the firebox has risen above a predetermined level.

If the system determines that the predetermined condition is present, it then determines whether damper 10 is open or closed based on the reading from damper sensing switch 12 (step 52). If damper 10 is closed, the system then activates alarm 37 (step 53), which may be any form of audible or visual indicator, or combination thereof. This alarm indicates to the occupants of the house that the safety system has been activated. The system also opens the damper (step 54), and activates the fan (step 55) by setting fan motor 41 for high speed operation. Fan motor 41 will remain on until the predetermined condition is no longer present. As a result, smoke generated from a fire in firebox 2 will be drawn through chimney 1 and exit at the top portion of flue 4, rather than entering the house. The system also activates smoke detector 25 (step 56) to ensure that the house occupants are alerted.

If the system determines that the predetermined condition is not present (step 51) or the damper is open (step 52), the system then checks whether smoke detector 25 has been activated (! step 56). If smoke detector 25 has been activated, the system then opens damper 10 (step 54) and activates the fan (step 55) by setting fan motor 41 on high. As a result, any smoke in the firebox will flow out of the house through chimney 1. Fan motor 41 will remain on until the smoke detractors no longer sense the presence of smoke. Thus, even if the firebox sensor or damper position sensor fails, the safety system will be activated when smoke detector 25 detects smoke generated from the firebox 2. If smoke detector 25 has not been activated (step 56), the system will return to the beginning of the safety control method (step 50) to repeat the safety control procedure.

A simplified block diagram of a control circuit 60 for the chimney safety control system of the present invention is shown in FIG. 6. One skilled in the art will recognize that this is only an illustrative example of the control circuit, and the present invention is not mean to be limited thereto. For example, the control circuit can be implemented using hardwired analog circuitry or digital circuitry, or can be in the form of a programmed digital system.

Control circuit 60 receives an input from smoke detector 25 on line 61 an input from firebox sensor 21 on line 62, and an input from damper sensing switch 12 on line 63. Input lines 62 and 63 are fed into the two inputs of an AND gate 64. In the embodiment shown in FIG. 6, a positive signal on line 62 corresponds to the detection of the predetermined condition by firebox sensor 21, and a positive signal on line 63 corresponds to detection that the damper is closed by damper sensing switch 12. AND gate 64 will provide a positive output on line 65 only if the signals on both lines 62 and 63 are positive, i.e., the predetermined condition is present and the damper is closed. The positive signal on line 65 will then activate alarm 37, and will be fed on line 68 to an input of smoke detector 25, activating smoke detector 25.

Input line 61 from smoke detector 25 is fed to one input of OR gate 66. In the embodiment shown in FIG. 6, a positive signal on line 61 corresponds to the condition that smoke detector 25 is activated. OR gate 66 receives its second input on line 68 from the output 65 of AND gate 64. OR gate 66 will provide a positive output on line 67 if the signal on either line 61 or line 65 is positive, i.e., if either smoke detector 25 is activated or both the predetermined condition exists and damper 10 is closed. When line 67 is positive, fan motor 41 will be activated at high speed and damper solenoid 11 will be activated to open damper 10.

A more detailed schematic diagram of an illustrative electrical circuit 70 for controlling the chimney safety and control system of the present invention is shown in FIG. 7. As shown in FIG. 7, circuit 70 receives as inputs signals from smoke detector 25, firebox sensor 21, and damper sensing switch 12. Circuit 70 outputs signals to fan motor 41, damper solenoid 11, and alarm 37. In the circuit of FIG. 7, the fan control switch 32 (shown in FIG. 3) is shown as a two pole, four position rotary switch having poles 76A and 76B. Light-emitting diodes 33 and 34 also correspond to the green and red fan indicators on control panel 31 (FIG. 3), and light emitting diodes 35 and 36 correspond to the green and red damper position indicators on control panel 31 (FIG. 3).

The operation of circuit 70 will be described below. Power is provided by the circuit on line 71. A transformer 160 reduces the line voltage to 14 volts AC, and a bridge rectifier 162 and capacitor 164 rectify and filter this voltage to produce a 14 volt DC unregulated supply voltage. Voltage rectifier 166 regulates this voltage to produce a stable 12 volt DC voltage supply, which is used to power all other low voltage control circuits and is referenced to AC input neutral.

Fan control switch 32 (see FIG. 3) includes pole 76A, which controls the light emitted from fan speed indicators 33 and 34. When fan control switch 76A is in the off position, current from voltage source Vcc runs through fan indicator LED 33 on path 72, causing LED 33 to emit red light, indicating that the fan is off. When fan control switch is placed in the "HI, " "MED," or "LO" positions, the current from voltage source Vcc is diverted to path 74 rather than path 72, causing fan speed indicator LED 34 to emit green light, indicating that the fan is on. Resistors 130 and 132 limit the current to LEDs 33 and 34

Pole 76B of fan control switch 32 controls fan motor 41. When fan control switch 76B is in the "HI," "MED" or "LOW" position, current from line 78 enters one of lines 80, 82, or 84, each including a resistor having a different resistance value. A current on line 80, 82, or 84 causes capacitor 134 to charge to the trigger voltage of diac 136 at three different rates, due to the three different resistance values. As a result, diac 136 triggers triac 138 at three different points in the AC cycle, producing three different proportional phase waveforms to fan motor 41, resulting in three different fan speeds. Resistor 142 and capacitor 144 form a standard snubber network to prevent false triggering of triac 138 when controlling an inductive load. In the preferred embodiment the resistance on line 80 is 200 ohms, the resistance on line 82 is 430K ohms, and the resistance on line 84 is 680K ohms. The connection of fan control switch 76B to the "OFF" position prevents any charging of capacitor 134.

Comparator 88 is used to monitor the I/O line 86 from smoke detector 25. The inverting input of comparator 88 is connected to a reference point 90, having a reference voltage of 6 volts in the preferred embodiment. The non-inverting input of comparator 88 is connected to a filter/regulator circuit 87 which monitors smoke detector I/O line 86. When no alarm is generated by smoke detector 25, I/O line 25 has a high voltage. This voltage is filtered and regulated by filter/regulator circuit 10 and output to the non-inverting input of comparator 88 as a voltage higher than the reference voltage at point 90 presented to the inverting input. As a result, the output of comparator 88 is off (open collector). When smoke detector 25 has been activated by the presence of smoke, I/O line 86 goes to a neutral or ground potential. Thus, the voltage at the non inverting input of comparator 88 will be zero volts, causing the output of comparator 88 to be on, pulling the output voltage to zero volts.

When the output from comparator 88 is on, LEDs 98 and 102 in optoisolators 94 and 96 are activated by the current to ground, causing current to flow in photo-triacs 100 and 104. This current also activates LED 34, which indicates that the fan is on. The current in photo-triac 100 forces triac 138 to turn on full, causing the fan motor 41 to be activated for high speed operation, regardless of the position of fan switch pole 76B. The current in photo-triac 104 turns on triac 140, which supplies current to damper solenoid 11, causing damper solenoid to open damper 10. Resistor 146 and capacitor 148 form a standard snubber network to prevent false triggering of triac 140 when controlling an inductive load.

Comparator 110 monitors the output of firebox sensor 21. In the embodiment shown in FIG. 7, firebox sensor 21 is a thermistor, and the voltage on input 106 varies with the temperature of the thermistor. Firebox sensor line 106 is connected to a resistor 150 to form a voltage divider. The resistance of resistor 150 is selected such that when the triggering temperature (125° F.) is reached, the voltage on line 106 presented to the inverting input of comparator 110 will be greater than the 6 volt reference presented to the non-inverting input of comparator 110. Thus, if a temperature below 125° F. is sensed, the output of Comparator 110 will be on, pulling the output to ground. Conversely, if the temperature rises to 125° F. or above the output of comparator 110 will be on (open collector).

Comparator 112 monitors the output of damper sensing switch 12. When damper sensing switch is open (indicating damper 10 is open) the voltage on line 108 is a high voltage (e.g., 12 volts) which is present at the inverting input of comparator 112. Because this voltage is greater than the reference voltage at point 90 (6 volts) connected to the non-inverting input of comparator 112, the output of comparator 112 is on, pulling the output to ground. As a result, the damper open LED 36 turns on, and diode 152 clamps the output of firebox sensor comparator 110 to ground, preventing the firebox sensor from generating an alarm while the damper is open.

When damper Sensing switch 12 is closed (indicating damper 10 is closed), the voltage on line 108 is zero volts, causing the damper closed LED 35 to turn on. Because the voltage at the inverting input of comparator 112 is less than the reference voltage (6 volts) at the non-inverting input, the output of comparator 112 is off (open collector) and no current will flow through diode 152.

Therefore, when the damper is closed and the firebox sensor senses a temperature of 125° F. or above, the output of comparator 110 will be at a voltage provided by reference Vcc (e.g. 12 volts). This voltage is fed to the inverting input of comparator 114. Because the voltage at the inverting input is greater than the reference voltage (6 volts) at the non-inverting input, the output of comparator 114 will be on, pulling the output to ground. This current to ground will cause transistor 116 to be off, allowing current to flow from voltage source Vcc into the base of transistors 120 and 122, turning transistors 120 and 122 on. Transistor 120 sinks the current through alarm 37 to ground, causing alarm 37 to activate. Transistor 122 pulls smoke detector I/O line 86 to ground, activating smoke detector 25 to sound an alarm, as well as all other connected smoke detectors. This condition will last only as long as it takes for comparator 88 to trip damper solenoid 11, causing damper 10 to open.

It should be recognized that the control circuit of the present invention is not limited to the specific embodiment described above, and a variety of different analog or digital systems may be alternatively employed.

Many possible modifications and changes may be made to the embodiments described above without straying from the applicants' present invention. Such modifications would be apparent to those skilled in the art and should not limit the scope of applicants' claimed invention. Applicants' invention is not meant to be limited to the particular embodiments described above, but rather the metes and bounds of the invention should be based on the claims appended hereto.

What is claimed is:

1. A chimney safety control and alarm apparatus comprising:

a chimney, including a firebox cavity, a damper, and a flue;

a ventilation means, mounted to a top portion of the chimney, for ventilating the chimney;

a damper positioning means for adjusting the position of the damper;

a damper position detecting means for determining the position of the damper, said damper position detecting means producing a damper position signal indicating the position of the damper;

a firebox sensing means for sensing a predetermined condition of the firebox, said firebox sensing means producing a firebox signal indicating the presence of the predetermined condition;

a smoke detector located in proximity to the firebox to detect the presence of smoke, said smoke detector having an internal alarm, said smoke detector providing a single input/output lead, said internal alarm being activated by externally pulling said input/output lead to ground, said input/output lead also pulled to ground internally by said smoke detector when smoke has been detected by said smoke detector; and a safety controller for activating the smoke detector internal alarm and the damper positioning means to open the damper and for activating the ventilation means to ventilate the chimney when the firebox signal received from the firebox sensing means indicates the presence of the predetermined condition within the firebox and the damper position signal received from the damper position detector means indicates that the damper is closed, said safety controller further activating said damper positioning means to open the damper and activating said ventilation means to ventilate the chimney when said smoke detector detects the presence of smoke in the proximity of said firebox;

said safety controller further comprising a transistor electrically coupled to said smoke detector input/output lead, said transistor for pulling said input/output lead to ground during the period in which the firebox signal is received from the firebox sensing means indicating the presence of the predetermined condition and the damper position signal is received from the damper position detector means indicating that said damper is closed, said safety controller transistor thereby activating said smoke detector internal alarm, for the period that said damper is open and said predetermined condition is detected in said firebox.

2. The chimney safety control and alarm apparatus of claim 1, wherein the safety controller activates the damper positioning means to open the damper and activates the ventilation means to ventilate the chimney when the smoke detector detects smoke.

3. The chimney safety control and alarm apparatus of claim 1, wherein the predetermined condition within the firebox is a temperature above a predetermined threshold.

4. The chimney safety control and alarm apparatus of claim 3, wherein said firebox sensing means comprises a thermistor and circuitry for detecting the presence of temperature above a predetermined threshold.

5. The chimney safety control and alarm apparatus of claim 1, wherein the predetermined condition within the firebox is the presence of smoke above a predetermined threshold.

6. The chimney safety control and alarm apparatus of claim 1, wherein the damper position controller is a solenoid.

* * * * *